US007866299B2

(12) United States Patent
Sato

(10) Patent No.: US 7,866,299 B2
(45) Date of Patent: Jan. 11, 2011

(54) IDLING STATE STABILIZING DEVICE FOR ENGINE

(75) Inventor: Kazuo Sato, Shizuoka-ken (JP)

(73) Assignee: Yamaha Motor Electronics Kabushiki Kaisha, Shizuoka (JP)

( * ) Notice: Subject to any disclaimer, the term of this patent is extended or adjusted under 35 U.S.C. 154(b) by 272 days.

(21) Appl. No.: 12/332,051

(22) Filed: Dec. 10, 2008

(65) Prior Publication Data

US 2009/0255509 A1 Oct. 15, 2009

(30) Foreign Application Priority Data

Apr. 15, 2008 (JP) ..... 2008-105563

(51) Int. Cl.
*F02D 41/16* (2006.01)
*F02D 41/00* (2006.01)

(52) U.S. Cl. ..... 123/339.2; 123/339.19

(58) Field of Classification Search ..... 123/339.1, 123/339.14, 339.15, 339.16, 339.18, 339.19, 123/339.2; 701/110
See application file for complete search history.

(56) References Cited

U.S. PATENT DOCUMENTS 6,283,079 B1 * 9/2001 Cumming et al. ..... 123/192.1
6,455,946 B2 * 9/2002 Taniguchi ..... 290/32

FOREIGN PATENT DOCUMENTS

JP 2003269216 A 9/2003

* cited by examiner

*Primary Examiner*—Mahmoud Gimie
(74) *Attorney, Agent, or Firm*—Keating & Bennett, LLP

(57) ABSTRACT

An idling state stabilizing device for an engine is disclosed that can decrease the torque that is necessary for rotation of a magneto by decreasing an output current, without setting an engine speed high, even though the engine is in the idling state, can stabilize the engine rotation, and accordingly can improve fuel economy, and further can reduce noises. A current value output from a generator when an engine is in an idling state is set as an output current value in a power generation control device. The power generation control device determines that the engine is in the idling state when the engine speed becomes equal to or less than an idling state rotational speed, detects the maximum engine speed and the minimum engine speed during a predetermined time period when the engine is in the idling state, calculates an engine speed fluctuation amount of the engine by subtracting the minimum engine speed from the maximum engine speed, and controls the current value output from the generator to be a low output current value which is lower than the previous output current value when the engine speed fluctuation amount is equal to or greater than a predetermined amount.

26 Claims, 5 Drawing Sheets

IDLING STATE STABILIZING DEVICE FOR ENGINE

CROSS-REFERENCE TO RELATED APPLICATIONS

The present application claims the benefit under 35 U.S.C. 119(a)-(d) to Japanese Patent Application No. JP2008-105563, filed on Apr. 15, 2008, the disclosure of which is incorporated herein by reference in its entirety.

BACKGROUND OF THE INVENTION

1. Field of the Invention

The present invention relates to an idling state stabilizing device for an engine that stabilizes an engine speed in an idling state.

2. Description of the Related Art

A power generating system employing an engine of a motorcycle uses a magnet type flywheel magneto generator coupled to the engine that generates electric power by rotating the flywheel magneto. The power generating system is designed to keep a predetermined low engine speed when the engine is in an idling state. A predetermined amount of torque is necessary to rotate the magneto. There may be some situations where the magneto cannot be steadily rotated when the engine speed decreases because the torque generated by the engine also decreases. Particularly, small motorcycle engines and other small engines are apt to have such problems. Conventionally, the engine idle speed is set to be high so as to provide sufficient torque to steadily rotate the magneto. Additionally, when a battery voltage exceeds a predetermined value, the battery and the generator are electrically disconnected from each other by a regulator to prevent electric power from being excessively supplied. However, under such a disconnected condition, the engine load does not change much because a short-circuit in the regulator continues to flow current from the generator.

Japanese Patent Publication No. 2003-269216A discloses a power generating system and a control method thereof in which a battery condition is detected in an idling state and an engine speed is increased in response to the battery condition. The system is controlled to increase the engine idle speed to prevent the battery power from being wholly discharged when the engine is in the idling state.

However, in both the conventional art discussed above and the system described in Japanese Patent Publication No. 2003-269216A, the engine speed is increased to maintain the power generated by the magneto. Consequently, the engine rotates uselessly in the idling state, which results in poor fuel economy. The increase of the engine speed results in additional noise generation, particularly in small engines, such as those used in motorcycles. It is undesirable to have noises generated in the idling state which have a magnitude similar to that in a normal running state.

SUMMARY OF THE INVENTION

In view of the circumstances noted above, an aspect of at least one of the embodiments disclosed herein is to provide an idling state stabilizing device for an engine that can decrease the torque that is necessary for rotation of a magneto by decreasing an output current, rather than setting an engine speed high to stabilize the rotation of the engine speed in the idling state. Other aspects of the present invention are to stabilize the engine speed in the idling state when the engine speed is low, to improve fuel economy and further to decrease engine noise.

In accordance with one aspect of the present invention, an idling state stabilizing device for an engine is provided. The idling state stabilizing device comprises a power generation control device disposed between a generator and one or more electrical components of a vehicle configured to provide an electric load to the generator. The generator may comprise a flywheel magneto with a magnet type three-phase power generating body coupled to the engine. The power generation control device may comprise a three-phase mixing bridge circuit configured to convert alternating current output from the flywheel magneto to direct current. The idling state stabilizing device may also comprise a control circuit comprising a microcomputer and an engine speed detector configured to measure a speed of the engine. The power generation control device may be configured to set a predetermined threshold engine speed value, at or below which the engine is determined to be in an idling state, as an idling state rotational speed value. The power generation control device may also be configured to set an idling state output current value of the generator as a normal output current value when the engine is in the idling state and determine an engine speed fluctuation amount of the engine within a predetermined time interval while the engine is in the idling state. The power generation control device determines that the engine is in the idling state when the engine speed detected by the engine speed detector is equal to or less than the idling state rotational speed. The power generation control device may be configured to control a current amount output by the generator to be a revised output current value lower than the normal output current value when the determined engine speed fluctuation amount is equal to or greater than a predetermined engine speed fluctuation amount.

In accordance with another aspect of the present invention, an idling state stabilizing device for an engine is provided that comprises a power generation control device disposed between a generator and an electric load to the generator. The power generation control device may be configured to set a predetermined threshold engine speed value, at or below which the engine is determined to be in an idling state, as an idling state rotational speed value. The power generation control device may also be configured to set an idling state output current value of the generator as a normal output current value when the engine is in the idling state and determine an engine speed fluctuation amount of the engine within a predetermined time interval while the engine is in the idling state. The power generation control device determines that the engine is in the idling state when an engine speed is equal to or less than the idling state rotational speed. The power generation control device may also be configured to control a current amount output by the generator to be a revised output current value lower than the normal output current value when the determined engine speed fluctuation amount is equal to or greater than a predetermined engine speed fluctuation amount.

In accordance with still another aspect of the present invention, a vehicle is provided that comprises a generator, one or more electric loads electrically connected to the generator and an idling state stabilizing device for an engine. The idling state stabilizing device comprises a power generation control device disposed between the generator and the one or more electric loads to the generator. The power generation control device may be configured to set a predetermined threshold engine speed value, at or below which the engine is determined to be in an idling state, as an idling state rotational speed value. The power generation control device may also be configured to set an idling state output current value of the generator as a normal output current value when the engine is in the idling state and determine an engine speed fluctuation amount of the engine within a predetermined time interval while the engine is in the idling state. The power generation control device determines that the engine is in the idling state when an engine speed is equal to or less than the idling state rotational speed. The power generation control device may be configured to control a current amount output by the generator to be a revised output current value lower than the normal output current value when the determined engine speed fluctuation amount is equal to or greater than a predetermined engine speed fluctuation amount.

In accordance with yet another aspect of the present invention, a method of stabilizing the idling state of an engine is provided with an idling state stabilizing device for an engine comprising an electric load, a generator, and a power generation control device. The method comprises of determining whether an engine speed is equal to or less than an idling state rotational speed. The method also comprises calculating an engine speed fluctuation amount of the engine within a predetermined time interval while the engine is in an idling state if the engine speed is equal to or less than the idling state rotational speed. The method further comprises determining whether the engine speed fluctuation amount is equal to or greater than a predetermined amount. The method also comprises changing an output current value from the generator to a new output current value, which is lower than a first output current value, when the engine speed fluctuation amount is equal to or greater than a predetermined amount.

DETAILED DESCRIPTION OF THE PREFERRED EMBODIMENTS

Figure 1:
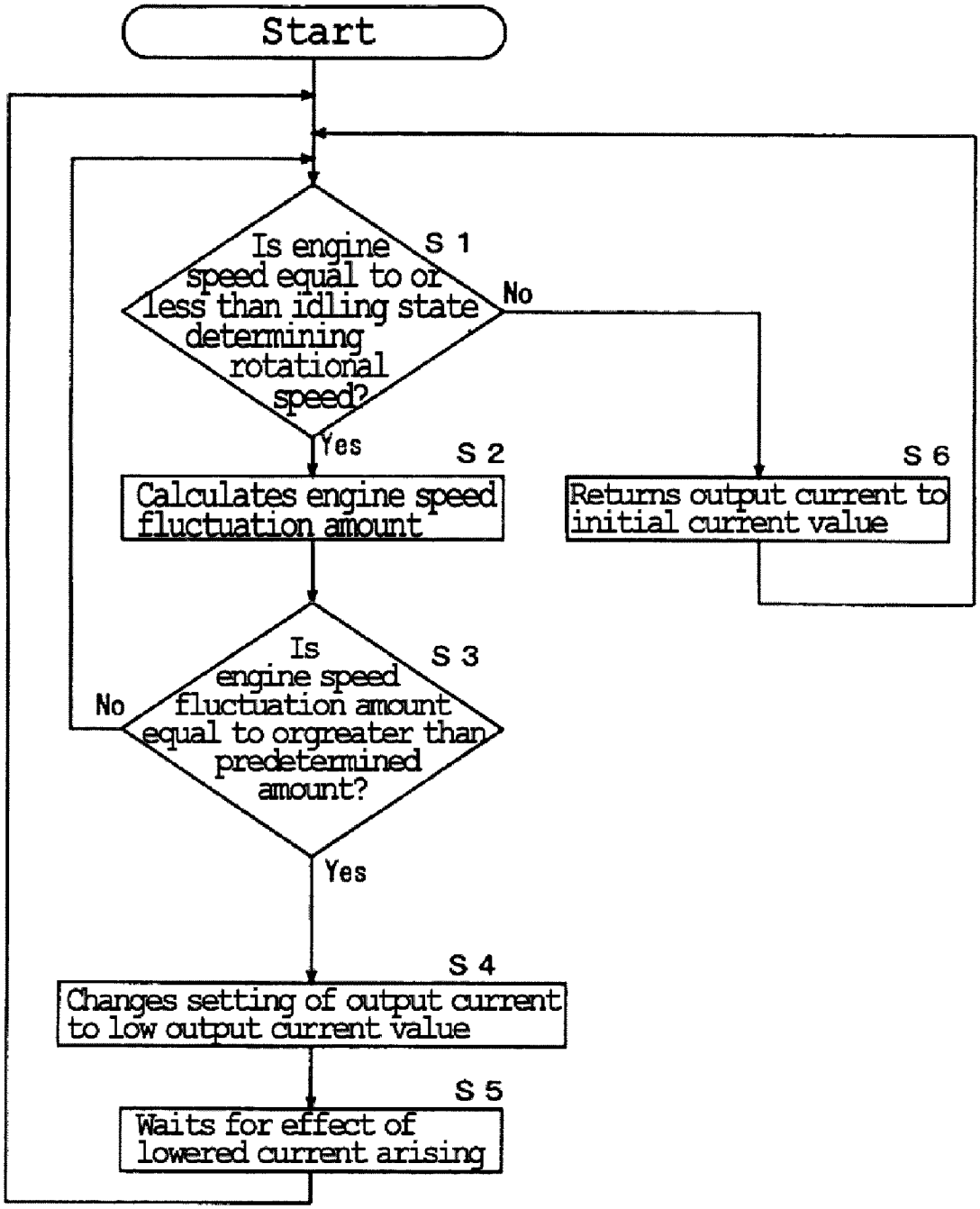
FIG. 1 is a flowchart showing an engine stabilizing method using an idling state stabilizing device for an engine in accordance with one embodiment.

FIG. 1 is a flowchart showing an engine stabilizing method using an idling state stabilizing device for an engine configured in accordance with one embodiment of the invention. Each step of the flowchart is described forthwith.

Step S1:

During an engine operation, a power generation control device can detect an engine speed and determine whether the engine speed is equal to or less than a predetermined idling state rotational speed. The idling state rotational speed is an engine speed value at which a vehicle body is in an idling state. For example, for a motorcycle the idling state rotational speed is usually equal to or less than approximately 2,000 rpm. Accordingly, if the engine speed is equal to or less than the idling state rotational speed, the vehicle can be determined to be in the idling state. An actual engine speed may be provided by measuring an output voltage from a generator attached to the engine, or may be provided based upon measuring the rotation of a projection (for example, see 37 of FIG. 4) coupled to the generator. Additionally, before performing Step S1, an initial output current value may be set in a microcomputer, and a current of the generator may be controlled to be set to the initial output current value at this Step S1.

Step S2:

If the engine is determined as idling at Step 1, an engine speed fluctuation amount can be calculated. The engine speed fluctuation amount may be calculated by subtracting the minimum engine speed from the maximum engine speed during a predetermined period of time.

Step S3:

In a preferred embodiment, the power generation control device determines whether the engine speed fluctuation amount is equal to or greater than a predetermined amount. That is, it determines whether the rotation of the engine is steady or unsteady. If this amount is equal to or greater than the predetermined amount, the engine rotation is determined to be unsteady. In contrast, if the amount is less than the predetermined amount, the engine rotation is determined to be steady. If the amount is less than the predetermined amount, i.e., the engine rotation is steady, the program returns back to Step S1. If the amount is equal to or greater than the predetermined amount, i.e., the engine rotation is unsteady, the program goes to Step S4.

Step S4:

If the engine speed fluctuation amount is equal to or greater than the predetermined amount at Step S3, i.e., the engine rotation is unsteady, the power generation control device may be used to set the output current to be a low value. The low output current value is a value lower than the initial output current value at an idling state that may be set in the power generation control device. Additionally, as described later, if the program returns back to Step S1 from Step S5 and again goes to Step S4, the next output current value set at Step S5 is changed and may be set to be an output current value which is lower than the previous output current value.

Step S5:

In a preferred embodiment, a waiting period of time is provided after the lower output current value is set at Step S4 before measuring an effect on the engine rotation. That is, because the engine rotation may not quickly stabilize to a value equal to or less than the predetermined value at Step S3 after the output current value is lowered, a length of time can be provided in which the engine rotation is observed. This waiting period of time may be longer than the predetermined length of time in which the engine speed fluctuation amount is calculated at Step S2. Afterwards, the program returns back to Step S1.

Step S6:

If the engine speed is determined to be a speed greater than the idling state rotational speed at Step S1, the output current set by the generator is returned to the initial value.

As thus described in a preferred embodiment, when the engine speed is unsteady, the output current value is controllably decreased, thereby continuously generating power while stabilizing the engine speed. Accordingly, the engine can output a desired current value, while keeping a low engine speed of rotation. Thus, the torque that is necessary for rotation of the magneto can be decreased and the engine rotation stabilized by decreasing the output current, without an engine speed being set high even in the idling state. That is, by detecting a fluctuation of the engine rotation and controlling the output current from the power control device, the stabilization of the engine speed in the idling state can be realized. As further effects, fuel economy can be improved and noises can be reduced.

If the engine is still in the idling state after the program has returned back to Step S1 from Step S5, the steps from Step S2 to Step S5 are repeated. If, in those steps, the engine speed fluctuation amount is equal to or greater than the predetermined amount, the current value outputted from the generator may be decreased again, and Steps S1-S5 are repeated until finally, an output current value can be set at which the engine speed does not become unsteady and the engine rotates steadily.

Figure 2:
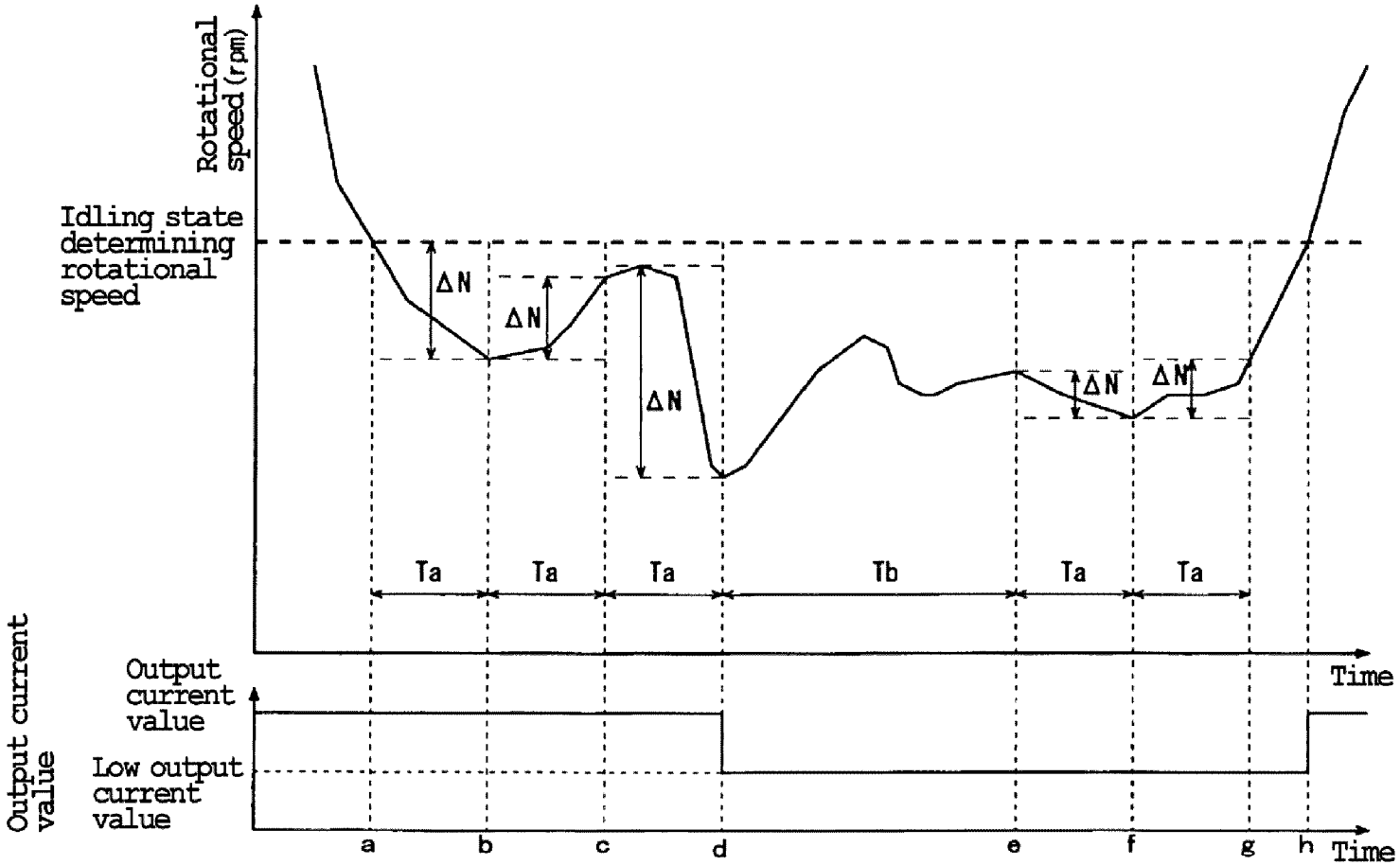
FIG. 2 is a graph showing relationships between an engine speed and time, and between an output current value and time for an engine in accordance with one embodiment.

FIG. 2 is a sample graph showing the relationships between engine speed and time and between an output current value and time, in a case where the idling state stabilizing method for an engine in accordance with one embodiment of this invention is used.

Until time "a", the vehicle body is in a running state. At time "a", the engine speed decreases to less than the idling state rotational speed, at which point it is determined that the vehicle body enters the idling state (Step S1 of FIG. 1). An engine speed fluctuation amount ΔN which may be a difference between the maximum engine speed and the minimum engine speed in a predetermined period of time Ta (time "a" to time "b") can be calculated (Step S2 of FIG. 1). If the amount ΔN is less than a predetermined amount, another engine speed fluctuation amount ΔN in the predetermined period of time Ta (time "b" to time "c") may again be calculated while making sure that the engine is still in the idling state. Because the amount ΔN during the period of time between the time "b" and the time "c" is also less than the predetermined amount, again a further engine speed fluctuation amount ΔN in the predetermined period of time Ta (time "c" to time "d") may be calculated while making sure that the engine is still in the idling state.

In FIG. 2, the amount ΔN is greater than the predetermined amount between time c and time d because the engine rotation during this period of time is unsteady. Accordingly, at time "d", the output current value may be changed to a lower output current value (Step S4 of FIG. 1). During a predetermined time Tb starting from the time "d" (i.e., time "d" to time "e"), the engine rotation may be watched to see whether there is an effect brought by the decreased output current (Step S5 of FIG. 1). After the predetermined time Tb has elapsed, still another engine speed fluctuation amount ΔN in the predetermined time Ta (time "e" to time "f") may be again calculated while making sure that the engine is still in the idling state. If the amount ΔN is less than the predetermined amount, this operation may be repeated (time "f" to time "g"). If the amount ΔN is greater than the predetermined amount, the output current value may be again changed to a lower output current value. When the engine speed increases to exceed the idling state rotational speed (time "h"), it is determined that the vehicle body is running, and the output current value may be returned to the initial output current value (Step S6 of FIG. 1).

Figure 3:
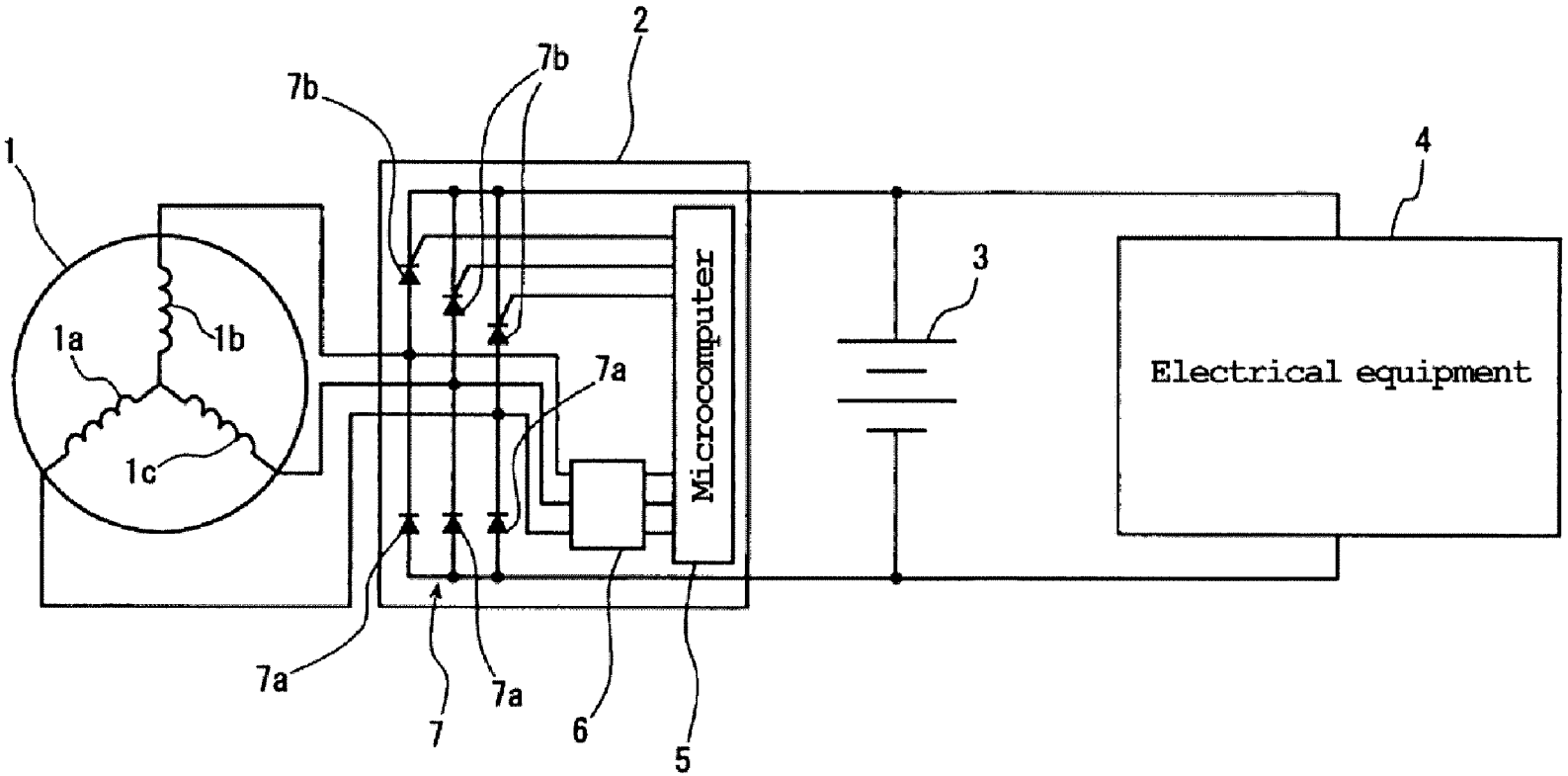
FIG. 3 is a schematic illustration of the idling state stabilizing device for an engine in accordance with one embodiment.

FIG. 3 is a schematic illustration of the idling state stabilizing device for an engine in accordance with one embodiment of this invention.

Figure 4:
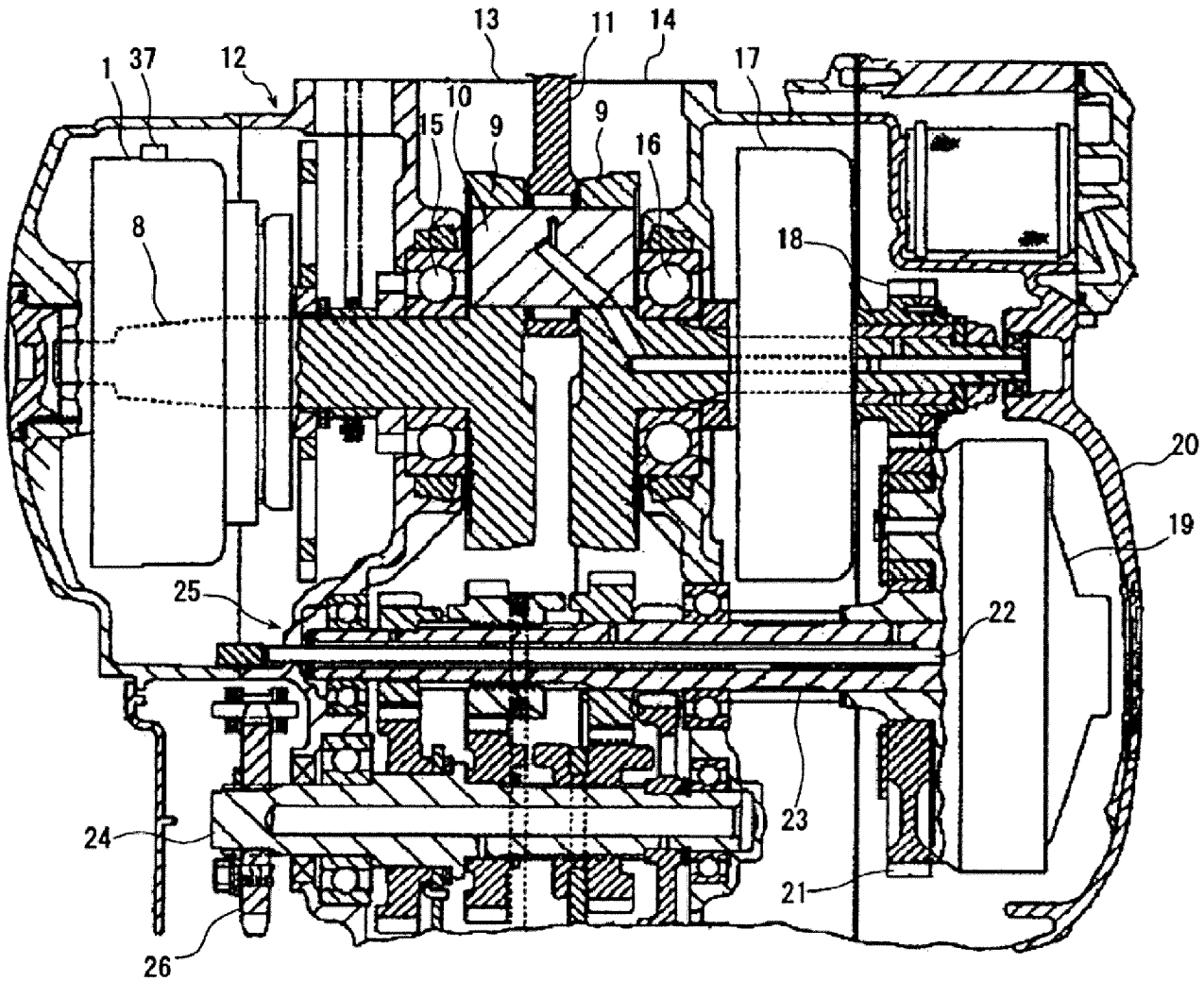
FIG. 4 is a partial, schematic and sectional view of one embodiment of an engine to which a flywheel magneto is mounted.
Figure 5:
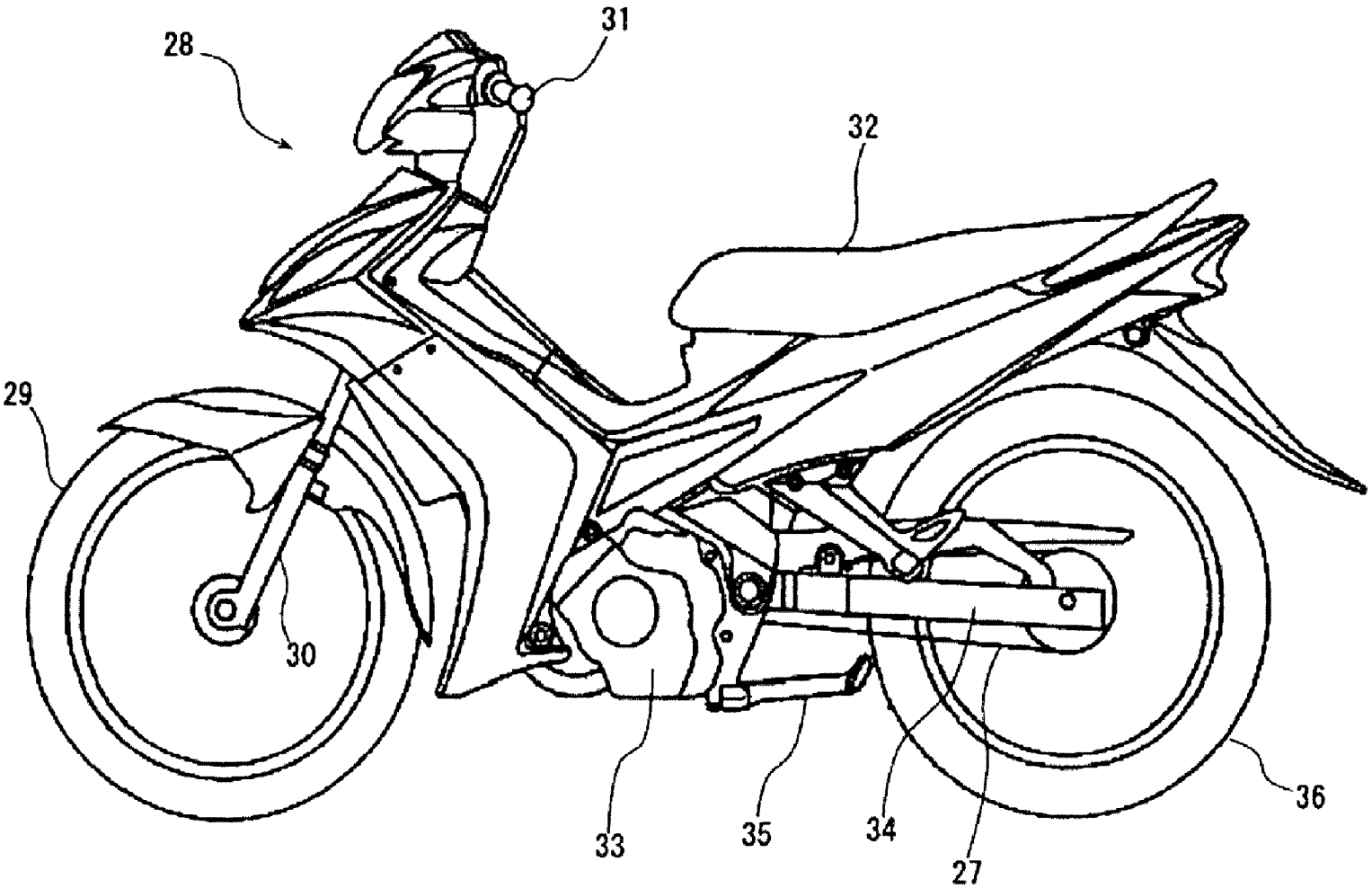
FIG. 5 is a schematic view of a motorcycle with an idling state stabilizing device for the engine, in accordance with one embodiment.

In some embodiments, a flywheel magneto 1 includes a magnet type three-phase power generating body mounted to the engine of a vehicle body (see FIGS. 4 and 5). In this flywheel magneto 1, a rotor (not shown) may rotate along with the rotation of a crankshaft 8 (see FIG. 4) of the engine, and stator coils 1*a*-1*c* can generate the electric power. The flywheel magneto 1 may be connected to a power generation control device 2, which controls the power to a battery 3 and pieces of electrical equipment 4. The electric power generated by the magneto 1 may be used to charge the battery 3 or be consumed by the electrical equipment 4, such as a brake lamp, flasher lamps and so forth.

The power generation control device 2 may include a microcomputer 5, a voltage detector 6 and a three-phase mixing bridge circuit 7. In one embodiment, the microcomputer 5 can store both the idling state rotational speed value and the initial current value described above, recognize when the engine enters the idling state, calculate the engine speed fluctuation current at this moment, and decrease the output current value if the engine rotation is unsteady. The voltage detector 6 can detect a voltage of the power generated by the magneto 1, and the engine speed may be calculated based upon this voltage. The detection results can be sent to the microcomputer 5. The three-phase mixing bridge circuit 7 may be a circuit that converts alternative current generated by the magneto 1 to direct current. The three-phase mixing bridge circuit 7 may include diodes 7*a* and thyristors 7*b* connected in series, to comprise the three-phase mixing bridge coupling.

The microcomputer 5 can change the current value output from the magneto 1 by changing a time at which a current (signal) flows through the gate of each thyristor 7*b*. Thus, the microcomputer 5 can properly change the output current value of the magneto 1. The idling state stabilizing method shown in FIG. 1 can be realized, accordingly.

FIG. 4 is a partial, schematic and sectional view of one embodiment of the engine to which the flywheel magneto is mounted.

The magneto 1 may be mounted to the crankshaft 8. The crankshaft 8 may include a pair of crank webs 9 and a crank pin 10 for connecting the crank webs 9. A connecting rod 11 is coupled with the crank pin 10, and a piston (not shown) is attached thereto. Those components are accommodated within a crankcase 12. The crankcase 12 may be formed with a left case 13 and a right case 14. The left case 13 and the right case 14 may have bearings 15, 16, respectively, which support the crankshaft 8 for rotation. Reference numeral 17 indicates a centrifugal clutch.

The crankshaft may be coupled with a main clutch 19 through reduction gears 18, 21. The main clutch 19 is covered with a clutch cover 20. A push rod 22 is provided to a center shaft of the main clutch 19 and is inserted into a main shaft 23. The main shaft 23, together with a drive shaft 24, forms a transmission. Reference numeral 26 indicates a sprocket to which a chain 27 described later is coupled.

FIG. 5 is a schematic view of an embodiment of a motorcycle to which the idling state stabilizing device for an engine, as described in the embodiments above, can be applied. Additionally, the inventions disclosed herein are not limited to a so-called motorcycle-type two-wheel vehicle, but are applicable to other types of two-wheel vehicles. Moreover, the inventions disclosed herein are not limited to two-wheel vehicles, but may be used with other types of straddle-type vehicle. Furthermore, some aspects of the invention disclosed herein are not limited to straddle-type vehicles, but can also be used with vehicles with side-by-side seating.

The motorcycle 28 may include a front wheel 29, a front fork 30, handle bars 31, a seat 32, an engine 33, a rear arm 34, a side stand 35 and a rear wheel 36. The rear wheel 36 may be driven by the engine 33 through the chain 27. By applying the idling state stabilizing device for an engine in accordance with an embodiment of this invention to an engine used for the motorcycle, the engine noise can advantageously be reduced in the idling state, and also fuel economy can be improved.

Particularly, in small engines used for motorcycles having a displacement around 125 cc to 250 cc, engine noises can be large when the engine speed is raised. The idling state stabilizing device is preferably applied to such engines, accordingly.

According to certain embodiments, the current value output from the generator is controlled to decrease when the engine is in the idling state and also when the engine speed fluctuation amount is equal to or greater than a predetermined amount during the predetermined time. Hence, power is continuously generated while the engine speed is steady, and the output current value is decreased when the engine speed becomes unsteady. Accordingly, the engine can output a desired current value, while keeping a low engine speed rotation. Thus, the torque that is necessary for rotation of the magneto can be decreased by decreasing the output current, without an engine speed being set high even in the idling state, and the engine speed is lowered to stabilize the engine rotation. Thereby, fuel economy can be improved and noises can be reduced.

In some embodiments, because the engine speed fluctuation amount is calculated by subtracting the minimum engine speed from the maximum engine speed, the engine speed fluctuation amount can be simply and easily determined, i.e., a state in which the engine rotation is unsteady or the like can be detected.

In certain embodiments, because the magneto generated voltage detector that detects a voltage generated by the generator is used as the engine speed detecting mechanism, a simple structure can be used to reliably detect the engine speed.

In some embodiments, the microcomputer sets a waiting time which is longer than the predetermined time, after the engine speed fluctuation amount has been controlled to be the low output current value. This allows the microcomputer to watch the engine rotation for a while because the engine rotation does not always become steady soon after the output current value has been decreased. Thereby, the accurate engine speed fluctuation amount at a certain engine speed can be calculated.

In some embodiments, even after the output current is decreased, the engine speed fluctuation amount is calculated after the waiting time has elapsed, whether the amount exceeds the predetermined amount or not is determined, and the output current is decreased again if the amount exceeds the predetermined amount. Then, such controls are repeated. Therefore, finally, the output current can converge to an output current value at which the engine can rotate steadily. Accordingly, the certain stabilization of the engine rotation can be realized.

Although these inventions have been disclosed in the context of a certain preferred embodiments and examples, it will be understood by those skilled in the art that the present inventions extend beyond the specifically disclosed embodiments to other alternative embodiments and/or uses of the inventions and obvious modifications and equivalents thereof In addition, while a number of variations of the inventions have been shown and described in detail, other modifications, which are within the scope of the inventions, will be readily apparent to those of skill in the art based upon this disclosure. It is also contemplated that various combinations or subcombinations of the specific features and aspects of the embodiments may be made and still fall within one or more of the inventions. Accordingly, it should be understood that various features and aspects of the disclosed embodiments can be combine with or substituted for one another in order to form varying modes of the disclosed inventions. Thus, it is intended that the scope of the present inventions herein disclosed should not be limited by the particular disclosed embodiments described above.

What is claimed is:

1. An idling state stabilizing device for an engine, comprising:

a power generation control device disposed between a generator comprising a flywheel magneto with a magnet type three-phase power generating body coupled to the engine and one or more electrical components of a vehicle configured to provide an electric load to the generator, the power generation control device comprising a three-phase mixing bridge circuit configured to convert alternating current output from the flywheel magneto to direct current, a control circuit comprising a microcomputer, and an engine speed detector configured to measure a speed of the engine;

the power generation control device configured to set a predetermined threshold engine speed value at or below which the engine is determined to be in an idling state as an idling state rotational speed value, and configured to set an idling state output current value of the generator as a normal output current value when the engine is in the idling state, the power generation control device further configured to determine an engine speed fluctuation amount of the engine within a predetermined time interval while the engine is in the idling state;

wherein the power generation control device determines that the engine is in the idling state when the engine speed detected by the engine speed detector is equal to or less than the idling state rotational speed, the power generation control device configured to control a current amount output by the generator to be a revised output current value lower than the normal output current value when the determined engine speed fluctuation amount is equal to or greater than a predetermined engine speed fluctuation amount.

2. The idling state stabilizing device for an engine according to claim 1, wherein the engine speed fluctuation amount is calculated by subtracting the minimum engine speed from the maximum engine speed.

3. The idling state stabilizing device for an engine according to claim 1, wherein the engine speed detector comprises a voltage detector configured to detect a voltage generated by the generator.

4. The idling state stabilizing device for an engine according claim 1, wherein the microcomputer is configured to measure the engine speed fluctuation amount following a set time period after the output current value is lowered below the normal output current value, the set time being longer than the predetermined time interval used in measuring the engine speed fluctuation amount.

5. The idling state stabilizing device for an engine according to claim 4, wherein the microcomputer, after the set time period has elapsed, is configured to:

measure the engine speed fluctuation amount again by detecting the maximum engine speed and the minimum engine speed during the predetermined time interval;

lowers the output current value from the generator to be less than the revised output current value if the engine speed fluctuation amount is equal to or greater than the predetermined amount; and wait a set time after the output current value is lowered to the revised output current value before measuring the engine speed fluctuation amount again.

6. An idling state stabilizing device for an engine, comprising:

a power generation control device disposed between a generator and an electric load to the generator, the power generation control device configured to set a predetermined threshold engine speed value at or below which the engine is determined to be in an idling state as an idling state rotational speed value, and configured to set an idling state output current value of the generator as a normal output current value when the engine is in the idling state, the power generation control device further configured to determine an engine speed fluctuation amount of the engine within a predetermined time interval while the engine is in the idling state, wherein the power generation control device determines that the engine is in the idling state when an engine speed is equal to or less than the idling state rotational speed, the power generation control device configured to control a current amount output by the generator to be a revised output current value lower than the normal output current value when the determined engine speed fluctuation amount is equal to or greater than a predetermined engine speed fluctuation amount.

7. The idling state stabilizing device for an engine according to claim 6, wherein the generator comprises a flywheel magneto with a magnet type three-phase power generating body coupled to the engine.

8. The idling state stabilizing device for an engine according to claim 6, wherein the electric load comprises one or more electrical components of a vehicle.

9. The idling state stabilizing device for an engine according to claim 6, wherein the engine speed fluctuation amount is calculated by subtracting a minimum engine speed from a maximum engine speed.

10. The idling state stabilizing device for an engine according to claim 6, wherein the engine is a vehicle engine, the vehicle comprising one or more electrical devices coupled to the generator.

11. The idling state stabilizing device for an engine according to claim 6, wherein the power generation control device comprises:

a converter configured to convert alternating current to direct current;

a control circuit for controlling a power generation; and an engine speed detector configured to measure a speed of the engine.

12. The idling state stabilizing device for an engine according to claim 11, wherein the converter is a three-phase mixing bridge circuit.

13. The idling state stabilizing device for an engine according to claim 11, wherein the converter converts alternating current output from a flywheel magneto to direct current.

14. The idling state stabilizing device for an engine according to claim 11, wherein the control circuit comprises a microcomputer.

15. The idling state stabilizing device for an engine according to claim 14, wherein the microcomputer is configured to measure the engine speed fluctuation amount following a set time period after an output current value is lowered below the normal output current value, the set time being longer than the predetermined time interval used in measuring the engine speed fluctuation amount.

16. The idling state stabilizing device for an engine according to claim 11, wherein the engine speed detector comprises a voltage detector configured to detect a voltage generated by the generator.

17. The idling state stabilizing device for an engine according to claim 15, wherein the microcomputer, after the set time period has elapsed, is configured to:

detect a maximum engine speed and a minimum engine speed during the predetermined time interval;

calculate the engine speed fluctuation amount;

lower the output current value from the generator to be less than the revised output current value if the engine speed fluctuation amount is equal to or greater than the predetermined amount;

wait a set time after the output current value is lowered to a new output current value before measuring the engine speed fluctuation amount again; and repeat the controls on the new output current value.

18. A vehicle comprising:

a generator;

one or more electric loads electrically connected to the generator; and an idling state stabilizing device for an engine comprising:

a power generation control device disposed between the generator and the one or more electric loads to the generator, the power generation control device configured to set a predetermined threshold engine speed value at or below which the engine is determined to be in an idling state as an idling state rotational speed value, and configured to set an idling state output current value of the generator as a normal output current value when the engine is in the idling state, the power generation control device further configured to determine an engine speed fluctuation amount of the engine within a predetermined time interval while the engine is in the idling state;

wherein the power generation control device determines that the engine is in the idling state when an engine speed is equal to or less than the idling state rotational speed, the power generation control device configured to control a current amount output by the generator to be a revised output current value lower than the normal output current value when the determined engine speed fluctuation amount is equal to or greater than a predetermined engine speed fluctuation amount.

19. The vehicle according to claim 18, wherein the vehicle is a two-wheeled vehicle.

20. A method of stabilizing the idling state of an engine, provided with an idling state stabilizing device for an engine comprising an electric load, a generator, and a power generation control device, comprising the steps of:

determining whether an engine speed is equal to or less than an idling state rotational speed;

calculating an engine speed fluctuation amount of the engine within a predetermined time interval while the engine is in an idling state if the engine speed is equal to or less than the idling state rotational speed;

determining whether the engine speed fluctuation amount is equal to or greater than a predetermined amount; and changing an output current value from the generator to a new output current value that is lower than an initial output current value when the engine speed fluctuation amount is equal to or greater than a predetermined amount.

21. The method of stabilizing the idling state of an engine according to claim 20, further comprising the step of waiting a set time after the output current value is lowered to the new output current value before measuring the engine speed fluctuation amount again.

22. The method of stabilizing the idling state of an engine according to claim 20, further comprising the step of setting the output current to the initial output current value if the engine speed is determined to be greater than the idling state rotational speed.

23. The method of stabilizing the idling state of an engine according to claim 20, further comprising the step of setting the idling state rotational speed value of the engine in the power generation control device as the threshold value at or below which the engine is predetermined to be in an idling state.

24. The method of stabilizing the idling state of an engine according to claim 20, further comprising the step of setting an idling state output current value of the generator as the output current value when the engine is in the idling state and setting the idling state output current value as the initial output current value.

25. The method of stabilizing the idling state of an engine according to claim 20, wherein the engine speed fluctuation amount is calculated by subtracting the minimum engine speed from the maximum engine speed.

26. The method of stabilizing the idling state of an engine according to claim 20, wherein the set time for waiting is longer than the predetermined time interval used in measuring the engine speed fluctuation amount.

* * * * *